US007639245B2

(12) United States Patent
Shimizu et al.

(10) Patent No.: US 7,639,245 B2
(45) Date of Patent: Dec. 29, 2009

(54) ELECTRO-OPTICAL DEVICE HAVING BOTH PARTIAL AND ENTIRE SCREEN DISPLAY MODES, AND METHOD OF DRIVING THE SAME

(75) Inventors: Koji Shimizu, Nagano (JP); Ryo Ishii, Nagano (JP)

(73) Assignee: Epson Imaging Devices Corporation, Tokyo (JP)

( * ) Notice: Subject to any disclaimer, the term of this patent is extended or adjusted under 35 U.S.C. 154(b) by 578 days.

(21) Appl. No.: 11/459,443

(22) Filed: Jul. 24, 2006

(65) Prior Publication Data

US 2007/0024552 A1 Feb. 1, 2007

(30) Foreign Application Priority Data

Jul. 26, 2005 (JP) ..... 2005-215460
Jan. 13, 2006 (JP) ..... 2006-005740

(51) Int. Cl.
*G09G 5/00* (2006.01)

(52) U.S. Cl. ..... 345/204; 345/100; 345/98; 345/87

(58) Field of Classification Search ..... 345/96, 345/204, 208, 209
See application file for complete search history.

(56) References Cited

U.S. PATENT DOCUMENTS 6,236,394 B1 * 5/2001 Ikeda ..... 345/211
6,667,732 B1 * 12/2003 Katase ..... 345/103
6,822,630 B2 * 11/2004 Moriwaki ..... 345/87
6,900,788 B2 * 5/2005 Yamazaki ..... 345/103
7,002,568 B2 * 2/2006 Morita ..... 345/211
7,327,341 B2 * 2/2008 Toriumi et al. ..... 345/98
2001/0052887 A1 * 12/2001 Tsutsui et al. ..... 345/87
2002/0005843 A1 * 1/2002 Kurumisawa et al. ..... 345/204
2003/0151577 A1 * 8/2003 Morita ..... 345/89
2003/0189539 A1 * 10/2003 Tamura ..... 345/89
2004/0160398 A1 * 8/2004 Yokota et al. ..... 345/87

FOREIGN PATENT DOCUMENTS

JP 2201-356746 12/2001

* cited by examiner

*Primary Examiner*—Richard Hjerpe
*Assistant Examiner*—Gregory J Tryder
(74) *Attorney, Agent, or Firm*—Lowe Hauptman Ham & Berner LLP

(57) ABSTRACT

An electro-optical device includes: an entire screen display mode and a partial display mode. In the entire screen display mode, positive and negative polarity image signals are supplied on the basis of a voltage that is greater than a voltage applied to the common electrode by a predetermined offset potential, and in the partial display mode, positive and negative polarity image signals are supplied on the basis of the voltage applied to the common electrode. In the partial display mode, the positive and negative polarity image signals are further corrected by the predetermined offset potential.

15 Claims, 7 Drawing Sheets

ELECTRO-OPTICAL DEVICE HAVING BOTH PARTIAL AND ENTIRE SCREEN DISPLAY MODES, AND METHOD OF DRIVING THE SAME

BACKGROUND

1. Technical Field

The present invention relates to an electro-optical device that uses an electro-optical material, such as liquid crystal, to a method of driving an electro-optical device, and to an electronic apparatus having an electro-optical device.

2. Related Art

In general, electro-optical devices, such as liquid crystal display devices for displaying images or the like, have been known. This electro-optical device includes, for example, a liquid crystal panel, and a driving circuit that drives the liquid crystal panel. For example, the electro-optical device has the following structure.

The electro-optical device includes a liquid crystal panel, a liquid crystal driving circuit that drives the liquid crystal panel, and a control circuit that controls the liquid crystal driving circuit. The liquid crystal driving circuit includes a scanning line driving circuit, a data line driving circuit, and a liquid crystal driving power supply circuit.

The liquid crystal panel includes an element substrate, a counter substrate, and liquid crystal serving as an electro-optical material. In the element substrate, thin film transistors (hereinafter, simply referred to as TFTs), which serve as switching elements (which will be described in detail below), are disposed in a matrix. The counter substrate is disposed so as to be opposite to the element substrate, and the liquid crystal is interposed between the element substrate and the counter substrate.

The element substrate includes a plurality of scanning lines that are provided at predetermined gaps, a plurality of data lines that are provided at predetermined gaps in a direction substantially orthogonal to the plurality of scanning lines, and capacitor lines that are disposed substantially parallel to the plurality of scanning lines and provided alternately with the plurality of scanning lines.

A plurality of pixels are provided at intersections between the plurality of data lines and the plurality of scanning lines. Each of the pixels includes a pixel electrode and a storage capacitor that has one end connected to the pixel electrode and the other end connected to the capacitor line, in addition to the above-mentioned TFT.

The TFT has a gate that is connected to the scanning line, a source that is connected to the data line, and a drain that is connected to the pixel electrode and the storage capacitor.

In the counter substrate, a plurality of common lines are provided so as to be substantially parallel to the plurality of scanning lines. In the counter substrate, a common electrode is formed so as to be opposite to the pixel electrodes. The common electrode is connected to the common line.

The electrode-optical device having the above-mentioned structure operates as follows. That is, a control signal is line-sequentially supplied, so that all of the pixels corresponding to a predetermined scanning line are selected. In addition, an image signal is supplied to the data line in synchronization with the selection of the pixel. Thereby, the image signal is supplied to all of the pixels selected by the control signal, so that the image data is written in the pixel electrode.

In the electro-optical device, in a state in which a voltage of the common electrode is used as a reference voltage, positive polarity writing, in which an image signal is supplied to the data line with a voltage greater than the voltage of the common electrode, and negative polarity writing, in which an image signal is supplied to the data line with a voltage smaller than the voltage of the common electrode, are alternately performed.

If the image signal is written in the pixel electrode of the pixel, a driving voltage is applied to the liquid crystal due to the potential difference between the pixel electrode and the common electrode. Accordingly, a voltage level of the image signal is changed, so that the alignment or order of the liquid crystal molecules is changed, which results in gray-scale display through optical modulation of each pixel.

In addition, the driving voltage that is applied to the liquid crystal is held by the storage capacitor for a longer time, namely, for a period as much as three orders of magnitude longer than the time for which the image signal is written.

In this case, in the electro-optical device having the above-mentioned structure, a parasitic capacitance is generated between the gate and the drain of the TFT. Also, a parasitic capacitance is generated between the source and the drain of the TFT. If the gate voltage of the TFT enters an off state, an electric charge accumulated in the storage capacitor and an electric charge accumulated in a pixel capacitor consisting of the pixel electrode and the common electrode are redistributed while including parasitic capacitances, which results in generating so-called pushdown that the voltage of the pixel electrode is reduced and the voltage applied to the liquid crystal is also reduced.

In both the positive polarity writing and the negative polarity writing, the pushdown is always generated. Therefore, a center voltage Vc, which is a center value between a positive polarity image signal and a negative polarity image signal, is set higher than the voltage VCOM of the common electrode by a dropped voltage due to the pushdown.

In the meantime, the electro-optical device having the above-mentioned structure is used in, for example, a portable apparatus. In recent years, the portable apparatus has been required to further reduce a consumed power. Accordingly, display is performed on an entire screen of a display screen (hereinafter, this case is referred to as an entire screen display mode), and display is performed on only a part of a display screen (hereinafter, this case is referred to as a partial display mode), which results in a decrease of a consumed power (for example, see JP-A-2001-356746).

In the electro-optical device disclosed in JP-A-2001-356746, in the partial display mode, a display screen is divided into a display region and a non-display region. On the display region, a remaining battery capacity or time is displayed, and nothing is displayed on the non-display region. That is, in a normally white mode, the non-display region is displayed with a white color, and in a normally black mode, the non-display region is displayed with a black color.

In the above-mentioned partial display mode, similar to the above-mentioned entire screen display mode, if a center voltage Vc of the image signal is set higher than a voltage VCOM of the common electrode by a dropped voltage due to the pushdown, even though nothing is displayed on the non-display region, the potential difference is always generated between the pixel electrode and the common electrode due to the pushdown, which results in an increase of a consumed power.

Accordingly, in the partial display mode, in order to reduce the consumed power in the non-display region, the center voltage Vc of the image signal is set so as to be the same as the voltage VCOM of the common electrode. Thereby, the consumed power is reduced in the non-display region.

However, in the partial display mode, if the center voltage Vc of the image signal is the same as the voltage VCOM of the common electrode, even through the consumed power in the non-display region can be reduced, in the display region, the center voltage Vc of the image signal becomes smaller than the voltage VCOM of the common electrode by an offset potential due to the pushdown. Therefore, burning or flickering may occur on the display region.

SUMMARY

An advantage the invention is that it provides an electro-optical device which is capable of preventing burning or flickering from occurring in a display region and reducing a consumed power in a non-display region in a partial display mode, a method of driving an electro-optical device, and an electronic apparatus.

According to a first aspect of the invention, there is provided an electro-optical device. The electro-optical device includes: a plurality of scanning lines; a plurality of data lines; a plurality of pixels that are provided so as to correspond to intersections between the plurality of scanning lines and the plurality of data lines, each of the pixels having a pixel electrode, a common electrode that is disposed so as to be opposite to the pixel electrode, and a switching element that allows, when a selection voltage is applied to the scanning line, the data line and the pixel electrode to enter a conductive state; a scanning line driving circuit that supplies a selection voltage for selecting the plurality of scanning lines in a predetermined order; and a data line driving circuit that supplies, when the scanning line is selected, an image signal to the corresponding data line. The data line driving circuit alternately performs positive polarity writing in which an image signal is supplied to the data line with a voltage greater than a voltage applied to the common electrode and negative polarity writing in which an image signal is supplied to the data lines with a voltage smaller than the voltage applied to the common electrode. An entire screen display mode in which an entire screen is used as a display region and a partial display mode in which a part of the entire screen is used as a display region and the other portion is used as a non-display region are selected. Further, in the entire screen display mode, a voltage greater than the predetermined voltage is applied to the common electrode, and the data line driving circuit alternately performs the positive polarity writing and the negative polarity writing on the basis of the voltage greater than the predetermined voltage. In the partial display mode, the predetermine voltage is applied to the common electrode, and the data line driving circuit alternately performs the positive polarity writing and the negative polarity writing on the basis of the predetermined voltage.

According to this aspect, the scanning line driving circuit line-sequentially supplies the selection voltage to the scanning lines, and the data line driving circuit alternately performs positive polarity writing in which an image signal is supplied to the data lines with a voltage greater than the voltage of the common electrode and negative polarity writing in which an image signal is supplied to the data lines with a voltage smaller than the voltage of the common electrode.

In this case, in the entire screen display mode, a voltage greater than a predetermined voltage is applied to the common electrode, and the data line driving circuit alternatively performs the positive polarity writing and the negative polarity writing on the basis of the voltage greater than the predetermined voltage.

In the meantime, in the partial display mode, a predetermined voltage is applied to the common electrode, and the data line driving circuit alternatively performs the positive polarity writing and the negative polarity writing on the basis of the predetermined voltage. Therefore, even though the partial display is performed, in the non-display region, the consumed power can be reduced, and in the display region, burning or flickering can be prevented on the screen.

Preferably, the data line driving circuit has a correction circuit that corrects the positive polarity writing image signal and the negative polarity writing image signal by a voltage greater than the predetermined voltage in the partial display mode.

According to this aspect, since the data line driving circuit has a correction circuit that corrects the positive polarity writing image signal and the negative polarity writing image signal by a voltage greater than the predetermined voltage in the partial display mode, the entire screen display mode and the partial display mode can be easily switched with a simple structure.

Preferably, the correction circuit has a partial display correction table, and corrects the image signal on the basis of the correction table.

According to this aspect, the partial display correction table is provided, and the image signal is corrected on the basis of the correction table. Therefore, as compared with a case in which the image signal is multiplied by the correction coefficient to correct it, since a small number of operation processes are required, the image signal can be corrected at a high speed.

According to a second aspect, there is provided an electronic apparatus including the above-mentioned electro-optical device.

According to this aspect, the same effect as the above can be obtained.

According to a third aspect of the invention, there is provided a method of driving an electro-optical device, the electro-optical device including a first substrate that has a plurality of scanning lines, a plurality of data lines that are substantially orthogonal to the plurality of scanning lines, and a plurality of pixels that are provided so as to correspond to intersections between the plurality of scanning lines and the plurality of data lines, each of the pixels having a pixel electrode and a switching element that connects or disconnects the data line to or from the pixel electrode in accordance with a control signal supplied from the scanning line; a second substrate that is disposed so as to be opposite to the first substrate; and an electro-optical material that is interposed between the first substrate and the second substrate. The second substrate has a common electrode. The method includes: alternately performing positive polarity writing and negative polarity writing, the positive polarity writing in which an image signal is supplied to the data lines with a voltage greater than a voltage of the common electrode while line-sequentially supplying the control signal to the scanning lines, in the negative polarity writing in which in which an image signal is supplied to the data lines with a voltage smaller than a voltage of the common electrode while line-sequentially supplying the control signal to the scanning lines; and correcting the image signal by an offset potential due to pushdown while allowing a center voltage of the image signal to be the same as the voltage of the common electrode, when the image signal is supplied to the data lines in the partial display mode.

According to this aspect, the same effect as the above can be obtained.

BRIEF DESCRIPTION OF THE DRAWINGS

The invention will be described with reference to the accompanying drawings, wherein like numbers reference like elements, and wherein.

DESCRIPTION OF EXEMPLARY EMBODIMENTS

Figure 1:
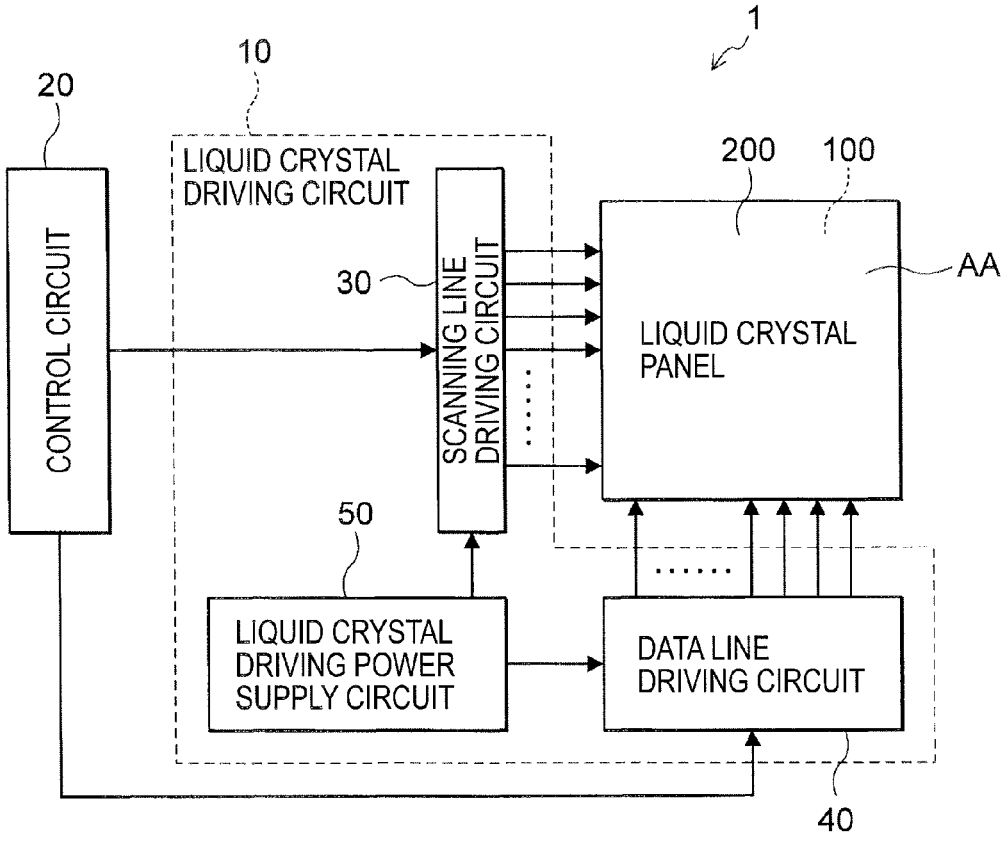
FIG. 1 is a block diagram illustrating a structure of an electro-optical device according to a first embodiment of the invention.

Hereinafter, preferred embodiments of the invention will be described in detail with reference to accompanying drawings. In the preferred embodiments and modifications, which will be described in detail below, the same constituent elements are denoted by the same reference numerals, and the description thereof will be omitted or simplified.

First Embodiment

FIG. 1 is a block diagram illustrating an electro-optical device 1 according to a first embodiment of the invention.

The electro-optical device 1 includes a liquid crystal panel AA, a liquid crystal driving circuit 10 that drives the liquid crystal panel AA, and a control circuit 20 that controls the liquid crystal driving circuit 10. The liquid crystal driving circuit 10 has a scanning line driving circuit 30, a data line driving circuit 40, and a liquid crystal driving power supply circuit 50.

Figure 2:
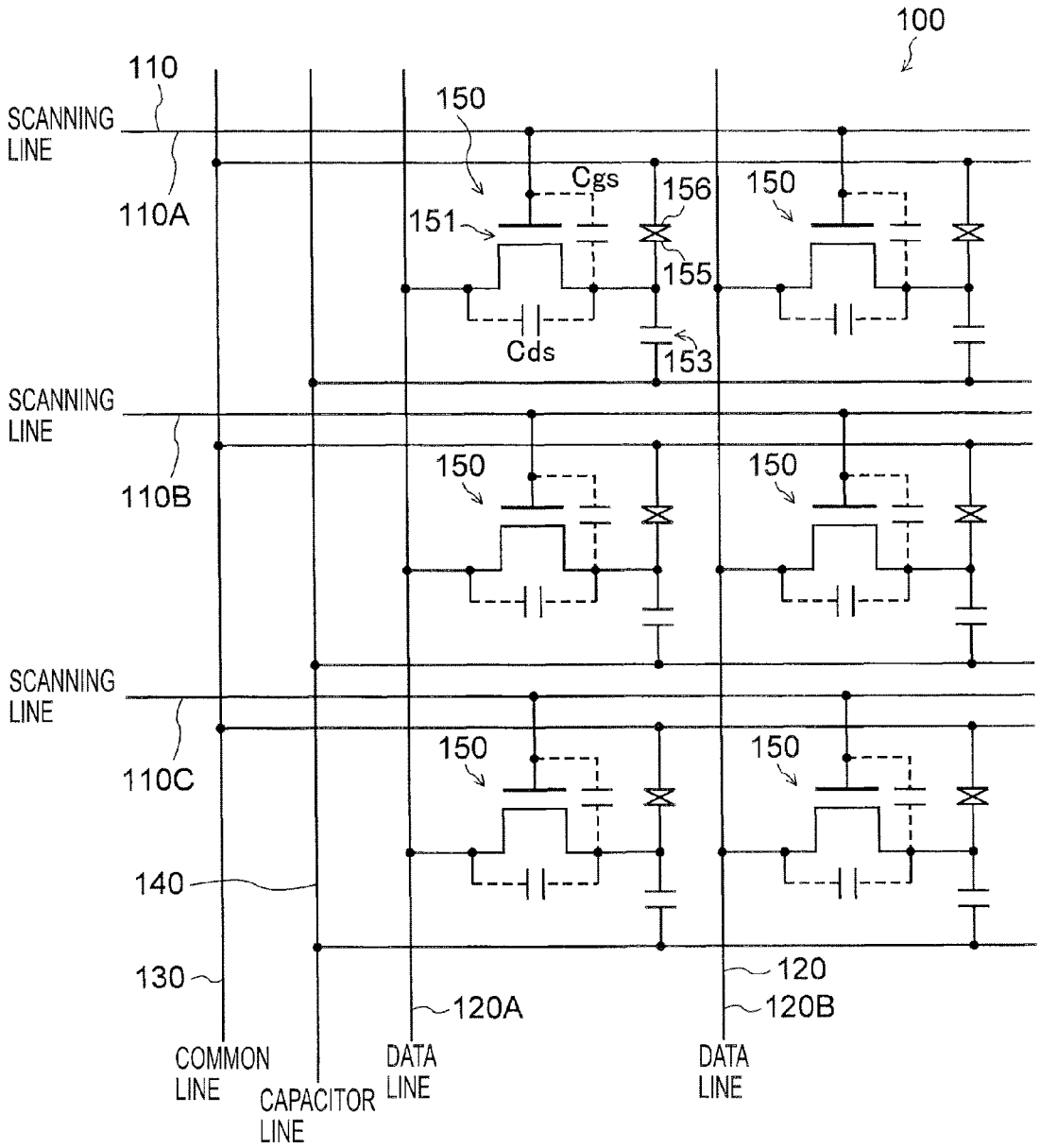
FIG. 2 is a partially enlarged plan view of a liquid crystal panel of the electro-optical device.

FIG. 2 is a partially enlarged plan view of the liquid crystal panel AA.

The liquid crystal panel AA includes an element substrate 100, a counter substrate 200, and liquid crystal (see FIG. 1). In this case, the element substrate 100 serves as a first substrate in which thin film transistors 151 (hereinafter, referred to as TFTs) serving as switching elements, which will be described in detail below, are disposed in a matrix, the counter substrate 200 serves as a second substrate which is disposed so as to be opposite to the element substrate 100, and the liquid crystal is an electro-optical material which is interposed between the element substrate 100 and the counter substrate 200.

The above-mentioned liquid crystal driving circuit 10 is formed on the element substrate 100 of the liquid crystal panel AA.

The element substrate 100 includes a plurality of scanning lines 110 that are provided at predetermined gaps, a plurality of data lines 120 that are disposed in a direction substantially orthogonal to the plurality of scanning lines 110 and provided at predetermined gaps, and capacitor lines 140 that are disposed substantially parallel to the plurality of scanning lines 110 and provided alternatively with the plurality of scanning lines 110. In FIG. 2, for example, the plurality of scanning lines correspond to scanning lines 110A, 110B, and 110C of the scanning lines 110, which are sequentially disposed from the top, and the plurality of data lines correspond to data lines 120A and 120B of the data lines 120 which are sequentially disposed from the left.

A plurality of pixels 150 are provided at intersections between the plurality of scanning lines 110 and the plurality of data lines 120. Each of the pixels 150 includes, in addition to the above-mentioned TFT 151, a pixel electrode 155, and a storage capacitor 153 that has one end connected to the pixel electrode 155 and the other end connected to the capacitor line 140.

A gate of the TFT 151 is connected to the scanning line 110, a source of the TFT 151 is connected to the data line 120, and a drain of the TFT 151 is connected to the pixel electrode 155 and the storage capacitor 153. The TFT 151 connects or disconnects the data line 120 to or from the pixel electrode 155 and the storage capacitor 153 in accordance with a selection voltage from the scanning line 110. Specifically, if the selection voltage is applied to the scanning line 110, it allows the data line 120, the pixel electrode 155, and the storage capacitor 153 to enter an electrically conductive state.

In the counter substrate 200, a plurality of common lines 130 are provided so as to be substantially parallel to the plurality of scanning lines 110. Further, in the counter substrate 200, a common electrode 156 is formed so as to be opposite to the pixel electrode 155, and the common electrode 156 is connected to the common line 130.

The scanning line driving circuit 30 line-sequentially supplies a selection voltage for allowing the TFTs 151 to be turned on or off to the respective scanning lines 110. For example, if the control signal is supplied to any scanning line 110, all of the TFTs 151 connected to the corresponding scanning line 110 are turned on, and all of the pixels corresponding to the scanning line 110 are selected.

The data line driving circuit 40 supplies an image signal to each data line 120, and sequentially writes the image data in the pixel electrode 155 of the pixel 150 through the TFT 151 which has been turned on. In a state in which a voltage of the common electrode 156 is used as a reference voltage, the data line driving circuit 40 alternately performs positive polarity writing in which the image signal is supplied to the data line 120 with a voltage greater than a voltage of the common electrode 156, and negative polarity writing in which the image signal is supplied to the data line 120 with a voltage smaller than a voltage of the common electrode 156.

In order to prevent the liquid crystal from being burned, the data line driving circuit 40 is driven in a 1H inversion driving mode in which the positive polarity writing and the negative polarity writing are alternately performed for every one horizontal line by using an alternating voltage.

Figure 3:
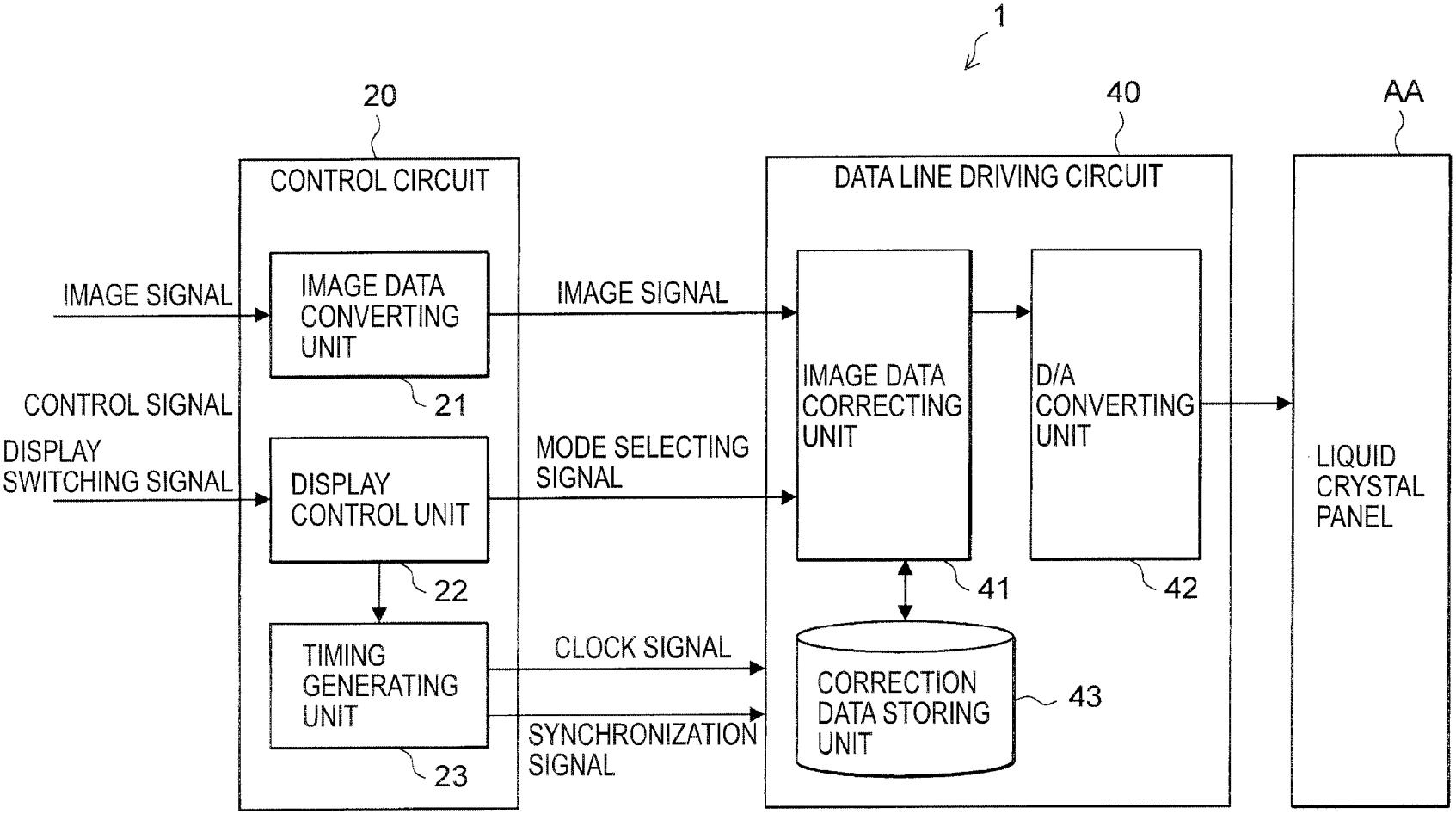
FIG. 3 is a block diagram illustrating a structure of a control circuit and a data line driving circuit that forms the electro-optical device.

FIG. 3 is a block diagram illustrating a structure of the control circuit 20 and the data line driving circuit 40.

A control circuit 20 includes an image data converting unit 21, a display control unit 22, and a timing generating unit 23.

The image data converting unit 21 converts the input image signal in accordance with the positive polarity writing mode or the negative polarity writing mode, and outputs the converted signal to the data line driving circuit 40.

The display control unit 22 selects any one of an entire screen display mode in which an entire screen is used as a display region and a partial display mode in which a part of an entire screen is used as a display region and other portion is used as a non-display region on the basis of the input display switching signal, and outputs a mode selection signal indicating the selected display mode to the data line driving circuit 40. In addition, the display control unit 22 outputs the input control signal to a timing generating unit 23.

The timing generating unit 23 output the clock signal CK or a synchronization signal SYNC to the data line driving circuit 40 in synchronization with the image signal output from the image data converting unit 21 to the data line driving circuit 40 on the basis of a control signal from the display control unit 22. In this case, the clock signal CK samples the data line and the synchronization signal SYNC assumes the synchronization with the scanning line driving circuit 30.

The data line driving circuit 40 includes an image data correcting unit 41 that serves as a correction circuit, a D/A converting unit 42, and a correction data storing unit 43.

The correction data storing unit 43 stores a correction coefficient for correcting an image signal in a partial display mode.

The D/A converting unit 42 performs D/A conversion on the image signal supplied from the image data correcting unit 41, and outputs it to the liquid crystal panel AA.

In addition, the image data correcting unit 41 may be constructed with a circuit for multiplying any coefficient, in stead of the correction data storing unit 43.

The image data correcting unit 41 performs γ correction having considered a light transmitting characteristic of the liquid crystal panel AA on the input image signal, and outputs it to the D/A converting unit 42.

In this case, when the mode selection signal from the display control unit 22 indicates the partial display mode, the correction coefficient is read from the correction data storing unit 43, and the image signal from the image data converting unit 21 is multiplied by the correction coefficient. Thereby, in a state in which the center voltage of the image signal in the positive polarity writing and the negative polarity writing is the same as the voltage of the common electrode, the image signal is corrected so as to become higher by an offset potential due to the pushdown. That is, in the partial display mode, in a state in which the voltage of the common electrode is used as a reference voltage, the positive polarity writing and the negative polarity writing are alternately performed.

In the meantime, when the mode selection signal from the display control unit 22 indicates the entire screen display mode, the image signal from the image data converting unit 21 is corrected such that the center voltage Vc of the image signal is greater than the voltage of the common electrode 156 by the offset potential due to the pushdown. That is, in a state in which the voltage greater than the voltage of the common electrode is used as the reference voltage, the positive polarity writing and the negative polarity writing are alternately performed.

In the entire screen display mode, the electro-optical device 1 having the above-mentioned structure operates as follows.

The scanning line driving circuit 30 line-sequentially supplies the control signal to the scanning line 110, so that all of the pixels 150 corresponding to one scanning line 110 are collectively selected. The data line driving circuit 40 supplies an image signal to the corresponding data line 120 in synchronization with the selection of the pixels 150. Thereby, the image signal is supplied to all of the pixels selected by the scanning line driving circuit 30, so that the image data is written in the pixel electrode 155.

If the image data is written in the pixel electrode 155, a driving voltage is applied to the liquid crystal by the potential difference between the pixel electrode 155 and the common electrode 156. Accordingly, a voltage level of the image signal is changed, so that the alignment or order of the liquid crystal molecules is changed, which results in gray-scale display through optical modulation of each pixel.

In addition, the driving voltage that is applied to the liquid crystal is held by the storage capacitor 153 for a longer time, namely, for a period as much as three orders of magnitude longer than the time for which the image signal is written.

In addition, in the partial display mode, the electro-optical device 1 having the above-mentioned structure operates as follows.

Figure 4:
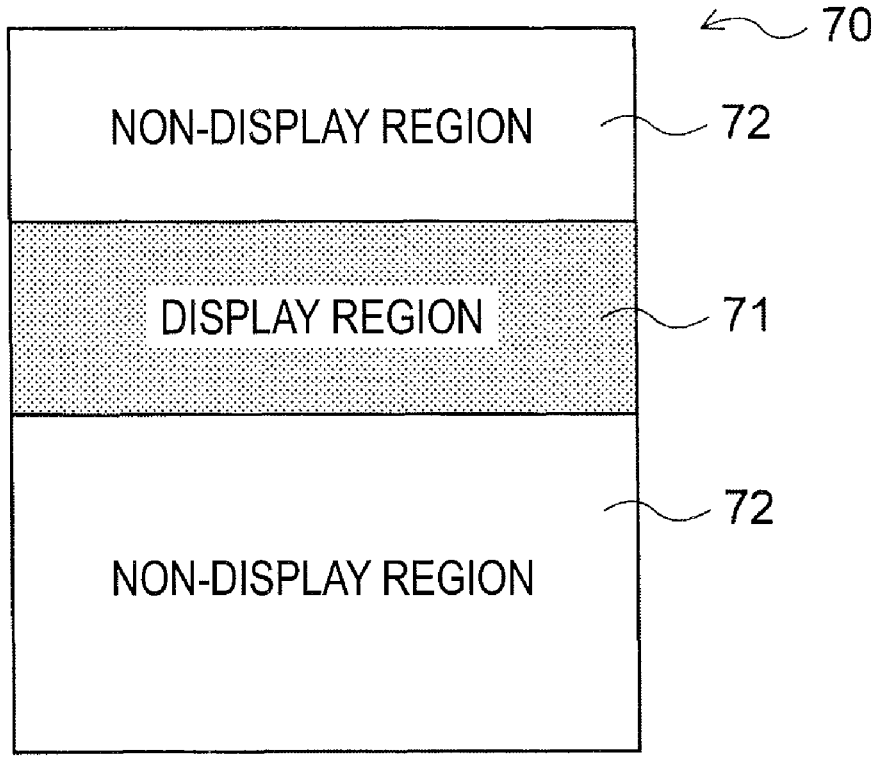
FIG. 4 is a diagram illustrating a display screen of a liquid crystal panel in a partial display mode.

FIG. 4 is a diagram illustrating a display screen of the liquid crystal panel AA in the partial display mode.

In the partial display mode, a display screen 70 is divided into a display region 71, and non-display regions 72 with the display region 71 interposed therebetween. On the display region 71, a remaining battery capacity or time is displayed, and nothing is displayed on the non-display regions 72. That is, in a normally white mode, the non-display region is displayed with a white color, and in a normally black mode, the non-display region is displayed with a black color.

In the above-mentioned partial display mode, the display region becomes narrower than that in the entire screen display mode, but one frame period is not changed. As a result, in the display region 71, a selection period per scanning line 110 becomes longer than a selection period per scanning line 110 in the entire screen display mode.

In addition, since nothing is displayed on the non-display regions 72, with a lower frequency than the display region 71, a frame is updated.

Hereinafter, the operation of the electro-optical device 1 in the entire screen display mode and the partial display mode will be described with reference to FIGS. 5 and 6.

Figure 5:
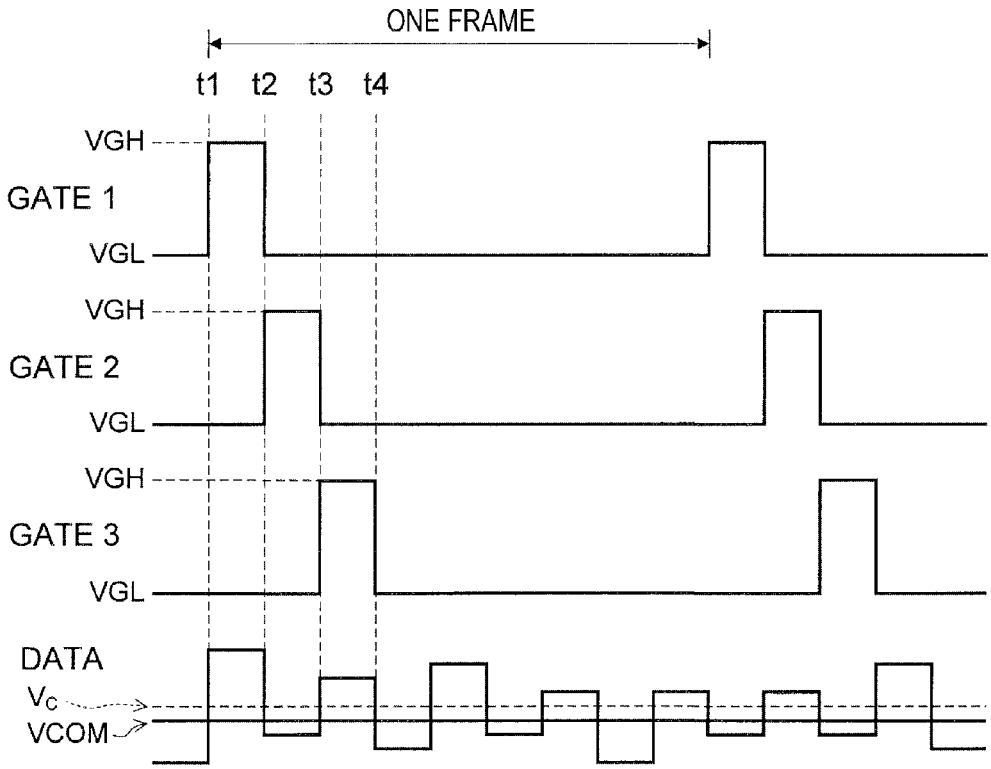
FIG. 5 is a timing chart in an entire screen display mode of the electro-optical device.
Figure 6:
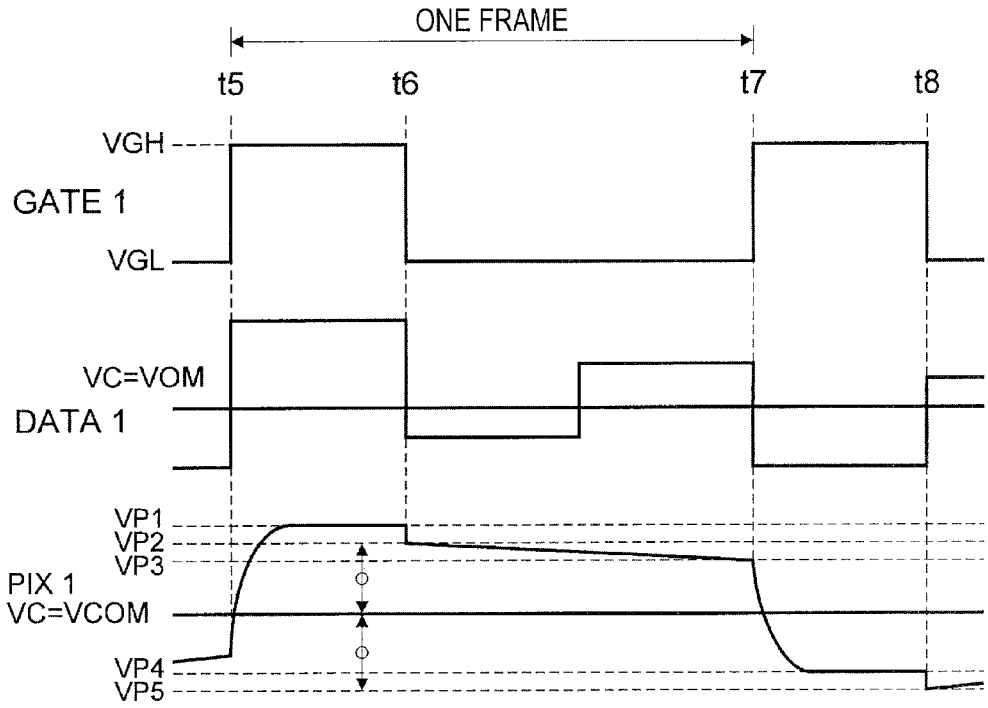
FIG. 6 is a timing chart in a partial display mode of the electro-optical device.

In FIGS. 5 and 6, GATE 1 to GATE 3 indicate voltages of the scanning lines 110A to 110C, DATA1 indicates a voltage of the data line 120A, and PIX1 indicates a voltage of the pixel 150 provided at the intersection between the scanning line 110A and the data line 120A. In addition, VCOM indicates a voltage of the common electrode 156, and Vc indicates a center value between the image signal in the positive polarity writing and the image signal in the negative polarity writing.

In the entire screen display mode, Vc becomes greater than VCOM by an offset potential due to the pushdown.

FIG. 5 is a timing chart illustrating the operation of the electro-optical device 1 in the entire screen display mode.

First, for a period of time from a time t1 to a time t2, the positive polarity writing is performed. That is, a control signal is supplied to the scanning line 110A by the scanning line driving circuit 30, a voltage GATE 1 of the scanning line 110A is set to a voltage VGH, and all of the TFTs 151 of one horizontal line corresponding to the scanning line 110A are turned on.

At the same time, with a voltage greater than the voltage VCOM of the common electrode 156, the data line driving circuit 40 supplies the image signal to the data line 120A such that the image data is written in the pixel electrode 155 through the TFT 151.

Next, for a period of time from a time t2 to a time t3, the negative polarity writing is performed. That is, a control signal is supplied to the scanning line 110B by the scanning line driving circuit 30, a voltage GATE 2 of the scanning line 110B is set to a voltage VGH, and all of the TFTs 151 of one horizontal line corresponding to the scanning line 110B are turned on.

At the same time, with a voltage smaller than the voltage of the common electrode 156, the data line driving circuit 40 supplies the image signal to the data line 120A such that the image data is written in the pixel electrode 155 through the TFT 151.

Next, for a period of time from a time t3 to a time t4, the positive polarity writing is performed. That is, a control signal is supplied to the scanning line 110C by the scanning line driving circuit 30, a voltage GATE 3 of the scanning line 110C is set to a voltage VGH, and all of the TFTs 151 of one horizontal line corresponding to the scanning line 110C are turned on.

At the same time, with a voltage greater than the voltage of the common electrode 156, the data line driving circuit 40 supplies the image signal to the data line 120A such that the image data is written in the pixel electrode 155 through the TFT 151.

As described above, the positive polarity writing and the negative polarity writing are alternately and repeatedly performed for every one horizontal scanning period in a 1H inversion driving mode, thereby generating one frame.

FIG. 6 is a timing chart illustrating the operation of the electro-optical device 1 in the partial display mode. In FIG. 6, for convenience of recognition, in both the positive polarity writing and the negative polarity writing, the writing is performed with the same gray-scale level. In this case, the selection period of one horizontal line in the partial display mode is three times as much as the selection period of one horizontal line in the entire screen display mode. Specifically, the period of time from a time t5 to a time t6 becomes equal to the period of time from a time t1 to a time t4.

In addition, in the partial display mode, Vc is the same as VCOM.

First, for a period of time from a time t5 to a time t6, the positive polarity writing is performed. That is, a control signal is supplied to the scanning line 110A by the scanning line driving circuit 30, a voltage GATE 1 of the scanning line 110A is set to a voltage VGH, and all of the TFTs 151 of one horizontal line corresponding to the scanning line 110A are turned on.

At the same time, with a voltage VP1 higher than the voltage of the common electrode 156, the data line driving circuit 40 supplies the image signal to the data line 120A such that the image data is written in the pixel electrode 155 and the storage capacitor 153 through the TFT 151.

Next, at the time t6, all of the TFTs 151 of one horizontal line corresponding to the scanning line 110A are turned off by the scanning line driving circuit 30. In this case, an electric charge accumulated in the storage capacitor 153 and an electric charge accumulated in a pixel capacitor consisting of the pixel electrode 155 and the common electrode 156 are redistributed while including parasitic capacitances Cgs and Cds, thereby generating pushdown. As a result, the voltage of the pixel electrode 155 is reduced to become VP2, and the potential difference between the voltage VP2 of the pixel electrode and the voltage VCOM of the common electrode 156 is applied to the liquid crystal.

For a period of time from a time t6 to t7, the electric charge accumulated in the pixel capacitor and the storage capacitor 153 is gradually discharged, and the voltage of the pixel electrode 155 is reduced to VP3.

Next, for a period of time from a time t7 to a time t8, the negative polarity writing is performed. That is, a control signal is supplied to the scanning line 110A by the scanning line driving circuit 30, a voltage GATE 1 of the scanning line 110A is set to a voltage VGH, and all of the TFTs 151 of one horizontal line corresponding to the scanning line 110A are turned on.

At the same time, with a voltage VP4 lower than the voltage of the common electrode 156, the data line driving circuit 40 supplies the image signal to the data line 120A such that the image data is written in the pixel electrode 155 and the storage capacitor 153 through the TFT 151.

Next, at the time t8, all of the TFTs 151 of one horizontal line corresponding to the scanning line 110A are turned off by the scanning line driving circuit 30. In this case, an electric charge accumulated in the storage capacitor 153 and an electric charge accumulated in a pixel capacitor consisting of the pixel electrode 155 and the common electrode 156 are redistributed while including parasitic capacitances Cgs and Cds, thereby generating pushdown. As a result, the voltage of the pixel electrode 155 is reduced to become VP5, and the potential difference between the voltage VP5 of the pixel electrode and the voltage VCOM of the common electrode 156 is applied to the liquid crystal.

According to the present embodiment, the following effects are obtained.

(1) In the partial display mode, the image data correcting unit 41 corrects the image signal in the positive polarity writing and the negative polarity writing by an offset potential due to the pushdown in a state in which the center voltage Vc is the same as the voltage VCOM of the common electrode. Therefore, even though the partial display is performed, in the non-display region 72, the consumed power can be reduced, and the flickering or burning in the screen can be prevented in the display region 71.

Modification

Further, the invention is not limited to the above-mentioned embodiments, but various changes and modifications can be made without departing from the spirit and scope of the invention.

For example, in the present embodiment, in the partial display mode, the correction coefficient is read from the correction data storing unit 43, the image signal from the image data converting unit 21 is multiplied by the correction coefficient, and the image signal is corrected. However, the invention is not limited thereto. That is, a γ correction table for partial display and a γ correction table for entire screen display are stored in the correction data storing unit, these γ correction tables are selectively read for reference, and the image signal may be corrected.

In this manner, in addition to the above-mentioned (1), the following effect can be obtained.

(2) As compared with a case in which the image signal is multiplied by the correction efficient to perform correction, since the small number of operation processes are required, it is possible to correct the image signal at a high speed.

In addition, in the present embodiments, the image data correcting unit 41 is provided in the data line driving circuit 40, but the present invention is not limited thereto, and the image data correcting unit 41 may be provided so as to be separated from the data line driving circuit.

In addition, in the above-mentioned embodiments, the invention is applied to the electro-optical device 1 using the liquid crystal, but the invention is not limited thereto, and may be applied to an electro-optical device using an electro-optical material other than the liquid crystal. The electro-optical material refers to a material in which an optical characteristic, such as transmittance or luminance, varies by the supply of an electric signal (current signal or voltage signal). For example, similar to the above-mentioned embodiment, the invention is applied to various electro-optical devices, such as a display panel using an OLED element, made of organic EL (electroluminescent), a light-emitting polymer, or the like, as an electro-optical material, an electrophoresis display panel in which microcapsule containing a colored liquid or a white particle dispersed in the liquid is used as an electro-optical material, a twisting ball display panel in which a twisting ball toned in a different color for each region having a different polarity is used as an electro-optical material, a toner display panel in which a black toner is used as an electro-optical material, or a plasma display panel in which high-pressure gas, such as helium or neon, is used as an electro-optical material. In addition, the invention may be applied to an electro-optical device of a transverse electric field type.

Application

Next, an electronic apparatus to which the electro-optical device 1 according to the above-mentioned embodiments is applied will be described.

Figure 7:
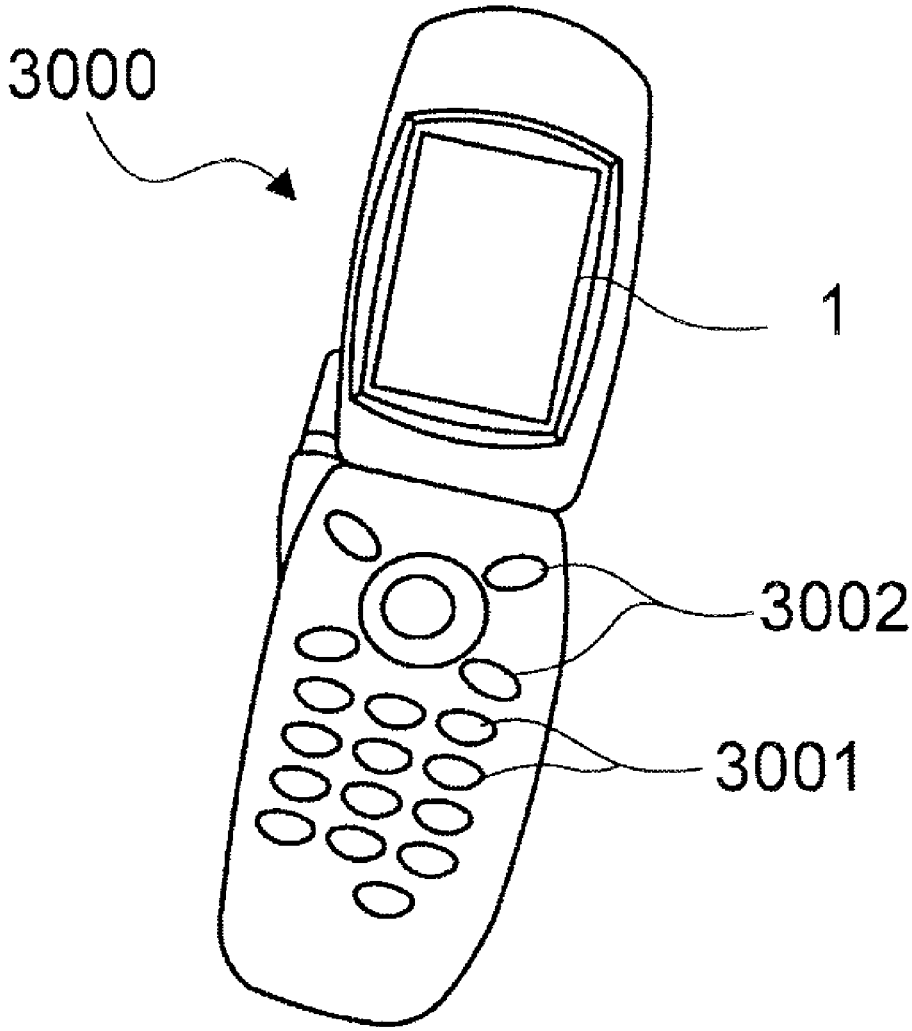
FIG. 7 is a perspective view illustrating a structure of a cellular phone to which the above-mentioned electro-optical device is applied.

FIG. 7 is a perspective view illustrating a structure of a cellular phone to which the above-mentioned electro-optical device 1 is applied. A cellular phone 3000 includes a plurality of operation buttons 3001, a scroll button 3002, and an electro-optical device 1. The scroll button 3002 is operated, so that a screen displayed on the electro-optical device 1 is scrolled.

In addition to the cellular phone shown in FIG. 7 as the electronic apparatus to which the electro-optical device 1 is applied, examples of the electronic apparatus may include a personal computer, a portable information terminal, a digital still camera, a liquid crystal television, a view-finder-type or monitor-direct-view-type video tape recorder, a car navigation device, a pager, an electronic note, an electronic calculator, a word processor, a work station, a video phone, a POS terminal, an apparatus having a touch panel, or the like. In addition, as display units of theses various electronic apparatuses, the above-mentioned electro-optical device can be used.

What is claimed is:

1. An electro-optical device, comprising:

a plurality of scanning lines;

a plurality of data lines;

a plurality of pixels that are provided so as to correspond to intersections between the plurality of scanning lines and the plurality of data lines, each of the pixels has a pixel electrode, a common electrode that is disposed so as to be opposite to the pixel electrode, and a switching element that allows, when a selection voltage is applied to the scanning line, the data line and the pixel electrode to enter a conductive state;

a scanning line driving circuit that supplies a selection voltage for selecting the plurality of scanning lines in a predetermined order; and a data line driving circuit that supplies, when the scanning line is selected, an image signal to the corresponding data line, wherein an entire screen display mode in which an entire screen is used as a display region and a partial display mode in which a part of the entire screen is used as a display region and the other portion is used as a non-display region are selected, in the entire screen display mode, the data line driving circuit alternately supplies a positive polarity image signal and a negative polarity image signal to the data lines on the basis of a predetermined voltage that is greater than a voltage applied to the common electrode, and in the partial display mode, the data line driving circuit alternately supplies a positive polarity image signal and a negative polarity image signal to the data lines on the basis of the voltage applied to the common electrode;

wherein the data line driving circuit has a correction circuit that corrects the positive polarity image signal and the negative polarity image signal by a predetermined voltage greater than the voltage applied to the common electrode in the partial display mode.

2. The electro-optical device according to claim 1, further comprising a partial display correction data storing unit, and wherein the correction circuit reads a correction coefficient from the correction data storing unit to correct an image signal.

3. The electro-optical device according to claim 2, wherein the correction circuit multiplies the image data by the correction coefficient so as to correct the corresponding image data.

4. An electronic apparatus, comprising the electro-optical device according to claim 1.

5. A method of driving an electro-optical device, the electro-optical device including:

a plurality of scanning lines;

a plurality of data lines;

a plurality of pixels corresponding to intersections between the plurality of scanning lines and the plurality of data lines, each of the pixels having:

a pixel electrode, a common electrode disposed opposite to the pixel electrode, and a switching element that allows, when a selection voltage is applied to the scanning line, the data line and the pixel electrode to enter a conductive state;

a scanning line driving circuit that supplies a selection voltage for selecting the plurality of scanning lines in a predetermined order; and a data line driving circuit that supplies, when the scanning line is selected, an image signal to the corresponding data line, wherein the device has an entire screen display mode in which an entire screen of the device is used as a display region, and a partial display mode in which a part of the screen is used as a display region and another part of the screen is used as a non-display region, the method comprising:

supplying, by the data line driving circuit, the image signal in form of alternating positive and negative polarity image signals to the data lines so that in the entire screen display mode, a center voltage of the positive and negative polarity image signals is greater than a voltage applied to the common electrode by a predetermined offset potential; and in the partial display mode, the center voltage of the positive and negative polarity image signals is the same as the voltage applied to the common electrode; and in the partial display mode, correcting the positive and negative polarity image signals by a correction circuit of the data line driving circuit, wherein the positive and negative polarity image signals are corrected based on the predetermined offset potential.

6. The method according to claim 5, further comprising storing a correction coefficient in a partial display mode correction data storing unit of the data line driving circuit, and reading, by the correction circuit, the correction coefficient from the storing unit to correct the positive and negative polarity image signals.

7. The method according to claim 6, wherein in said correcting, the correction circuit multiplies image data of the image signal by the correction coefficient.

8. The method according to claim 5, wherein in said correcting, the positive and negative polarity image signals are corrected to be higher by the predetermined offset potential.

9. The method according to claim 5, wherein the predetermined offset potential is an offset potential caused by pushdown in the electro-optical device.

10. An electro-optical device, comprising:

a plurality of scanning lines;

a plurality of data lines;

a plurality of pixels corresponding to intersections between the plurality of scanning lines and the plurality of data lines, each of the pixels having:

a pixel electrode, a common electrode disposed opposite to the pixel electrode, and a switching element for electrically connecting, when a selection voltage is applied to the scanning line, the data line and the pixel electrode;

a scanning line driving circuit for supplying a selection voltage for selecting the plurality of scanning lines in a predetermined order; and a data line driving circuit for supplying, when the scanning line is selected, an image signal to the corresponding data line;

wherein the device has an entire screen display mode in which an entire screen of the device is used for displaying images, and a partial display mode in which a part of the screen is used for displaying images, and another part of the screen is not used for displaying images, wherein the data line driving circuit is configured for supplying the image signal in form of alternating positive and negative polarity image signals to the data lines so that in the entire screen display mode, a center voltage of the positive and negative polarity image signals is greater than a voltage applied to the common electrode by a predetermined offset potential; and in the partial display mode, the center voltage of the positive and negative polarity image signals is the same as the voltage applied to the common electrode; and wherein the data line driving circuit comprises a correction circuit for correcting, in the partial display mode, the positive and negative polarity image signals based on the predetermined offset potential.

11. The electro-optical device according to claim 10, wherein the data line driving circuit further comprises a partial display mode correction data storing unit for storing a correction coefficient adapted to be read out by the correction circuit to correct the positive and negative polarity image signals.

12. The electro-optical device according to claim 11, wherein the correction circuit is configured for multiplying image data of the image signal by the correction coefficient.

13. The electro-optical device according to claim 10, wherein the correction circuit is configured for correcting the positive and negative polarity image signals to be higher by the predetermined offset potential.

14. The electro-optical device according to claim 10, wherein the predetermined offset potential is an offset potential caused by pushdown in the electro-optical device.

15. An electronic apparatus, comprising the electro-optical device according to claim 10.

* * * * *